US011773646B2

(12) United States Patent
Wagemans

(10) Patent No.: US 11,773,646 B2
(45) Date of Patent: Oct. 3, 2023

(54) CORNER CLEATS WITH WIRING PASSAGEWAY

(71) Applicant: Arconic Technologies LLC, Pittsburgh, PA (US)

(72) Inventor: Johannes Hubertus Mario Wagemans, Apeldoorn (NL)

(73) Assignee: Arconic Technologies LLC, Pittsburgh, PA (US)

( * ) Notice: Subject to any disclaimer, the term of this patent is extended or adjusted under 35 U.S.C. 154(b) by 127 days.

(21) Appl. No.: 17/296,705

(22) PCT Filed: Dec. 11, 2018

(86) PCT No.: PCT/US2018/064856
§ 371 (c)(1),
(2) Date: May 25, 2021

(87) PCT Pub. No.: WO2020/122871
PCT Pub. Date: Jun. 18, 2020

(65) Prior Publication Data

US 2022/0049542 A1 Feb. 17, 2022

(51) Int. Cl.
*E06B 3/96* (2006.01)
*E06B 3/968* (2006.01)

(52) U.S. Cl.
CPC ..... *E06B 3/9687* (2013.01); *E06B 3/9681* (2013.01)

(58) Field of Classification Search
CPC ..... E06B 3/96; E06B 3/964; E06B 3/9644; E06B 3/9645; E06B 3/9649; E06B 3/968; E06B 3/9681; E06B 3/9682; E06B 3/9687; E06B 3/9688
See application file for complete search history.

(56) References Cited

U.S. PATENT DOCUMENTS 4,570,406 A * 2/1986 DiFazio ..... E04C 2/384 403/402
11,286,710 B2 * 3/2022 Pedersen ..... E06B 3/5885
2005/0193680 A1 * 9/2005 Wang ..... E06B 3/9688 52/656.9

(Continued)

FOREIGN PATENT DOCUMENTS

CN 201059392 Y 5/2008
CN 104110197 A 10/2014

(Continued)

OTHER PUBLICATIONS

ISRWO in related PCT/US2018/064856 dated Aug. 23, 2019.

*Primary Examiner* — Ryan D Kwiecinski
(74) *Attorney, Agent, or Firm* — Vorys, Sater, Seymour, and Pease LLP

(57) ABSTRACT

A framed assembly includes a first frame member defining a first inner channel, a second frame member defining a second inner channel and positioned adjacent the first frame member at a corner joint, and a corner cleat having a first leg received within the first inner channel and terminating at a first end of the corner cleat, and a second leg received within the second inner channel and terminating at a second end of the corner cleat. A passageway is defined in the corner cleat and extends between the first and second ends. The passageway places the first inner channel in communication with the second inner channel.

20 Claims, 4 Drawing Sheets

(56) References Cited

U.S. PATENT DOCUMENTS

2022/0049542 A1* 2/2022 Wagemans ..... E06B 3/9681

FOREIGN PATENT DOCUMENTS

| | | | | | |
|---|---|---|---|---|---|
| CN | 205243357 | U | | 5/2016 | |
| CN | 205531111 | A | | 8/2016 | |
| CN | 107939234 | A | * | 4/2018 | ..... E06B 3/968 |
| CN | 108756610 | A | * | 11/2018 | ..... E06B 3/04 |
| CN | 112065229 | A | * | 12/2020 | |
| CN | 113323560 | A | * | 8/2021 | ..... E06B 3/96 |
| CN | 113756689 | A | * | 12/2021 | |
| DE | 1108407 | B | * | 6/1961 | |
| DE | 1509155 | A1 | * | 1/1969 | |
| DE | 1509155 | A1 | * | 1/1969 | |
| DE | 4305377 | A1 | * | 9/1994 | ..... E06B 3/9645 |
| DE | 102017217183 | B3 | * | 2/2019 | ..... E06B 3/26301 |
| EP | 3569808 | A2 | * | 11/2019 | ..... E06B 3/9641 |
| EP | 3660258 | A1 | * | 6/2020 | ..... E06B 3/9649 |
| GB | 2036912 | A | * | 7/1980 | ..... E06B 3/5821 |
| GB | 2118668 | A | * | 11/1983 | ..... E06B 3/5821 |
| GB | 2252998 | A | * | 8/1992 | ..... E06B 3/9644 |
| GB | 2590892 | A | * | 7/2021 | ..... E06B 3/96 |
| WO | WO-9308360 | A1 | * | 4/1993 | ..... A47G 1/0644 |
| WO | WO-9955996 | A1 | * | 11/1999 | ..... B29C 65/524 |
| WO | 03076755 | A1 | | 9/2003 | |
| WO | WO-2007102177 | A1 | * | 9/2007 | ..... E06B 3/9649 |
| WO | WO-2020122871 | A1 | * | 6/2020 | ..... E06B 3/9681 |

* cited by examiner

CORNER CLEATS WITH WIRING PASSAGEWAY

BACKGROUND

Most commercial and residential buildings incorporate framed structures or assemblies that form window frames, window vents, glazing panels, doorframes, etc. Framed assemblies typically include elongated frame members connected at their adjacent ends and forming corners to the framed assemblies. The frame members are commonly formed as hollow, rectangular tubes typically made from rolled sheet metal or extruded aluminum or a polymer. At the corners of the framed assemblies, the ends of the frame members are interconnected and stabilized using one or more corner cleats, alternately referred to as "corner brackets."

With modern technological advances, there has been a corresponding increase in electrical applications available for framed assemblies, such as automated locks, door handles with fingerprint scanners, windows with integrated solar panels, windows with solar shading, heated glass, sensors (e.g., temperature, motion, etc.), etc. Each of these applications typically requires wiring to facilitate the transfer of electricity and/or data.

While wiring can always be attached to the exterior of the framed assembly, a more "clean" finish requires the wiring to be run through the interior of the frame members. Conventional corner cleats, however, are not designed to accommodate wiring through the corners of the framed assemblies. Instead, routing wiring through the corners requires installers to either remove and rebuild portions of the framed assembly with the necessary wiring in place, or otherwise multiple holes are drilled in the framed assembly to bypass the corners on the exterior of the frame members. As will be appreciated, these processes can be time-consuming, labor-intensive, and/or otherwise result in sloppy artisanship that leaves exposed (visible) wiring.

Accordingly, it has been considered desirable to develop new and improved corner cleats for framed assemblies that might overcome the foregoing difficulties and others while providing better and more advantageous overall results.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is generally related to framed assemblies for windows and doors and, more particularly, to corner cleats used at the corner joints of framed assemblies that enable the passage of wiring therethrough.

The embodiments discussed herein describe framed assemblies that incorporate novel corner cleats that help stabilize and secure corner joints. The corner cleats described herein also facilitate the passage of wiring between adjacent frame members via a passageway defined through the corner cleat. This may prove advantageous in hiding the wiring within the framed assembly so the construction appears neat or "clean." The embodiments described herein may also prove advantageous in reducing time and effort required to install wiring in framed assemblies.

One example framed assembly includes a first frame member defining a first inner channel, a second frame member defining a second inner channel and positioned adjacent the first frame member at a corner joint, and a corner cleat having a first leg received within the first inner channel and terminating at a first end of the corner cleat, and a second leg received within the second inner channel and terminating at a second end of the corner cleat. A passageway may be defined in the corner cleat and extend between the first and second ends. The passageway may place the first inner channel in communication with the second inner channel.

Figure 1B:
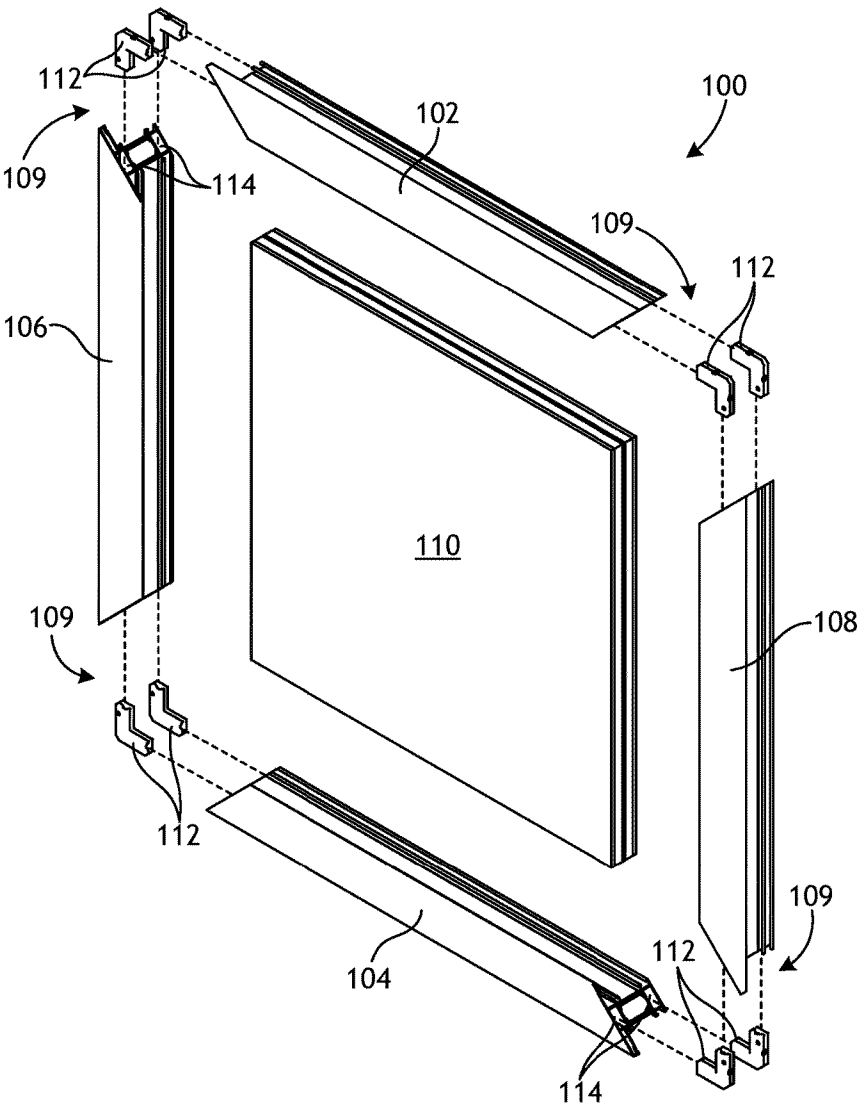
FIGS. 1A and 1B are isometric and exploded views, respectively, of an example framed assembly that may incorporate one or more principles of the present disclosure.
Figure 1A:
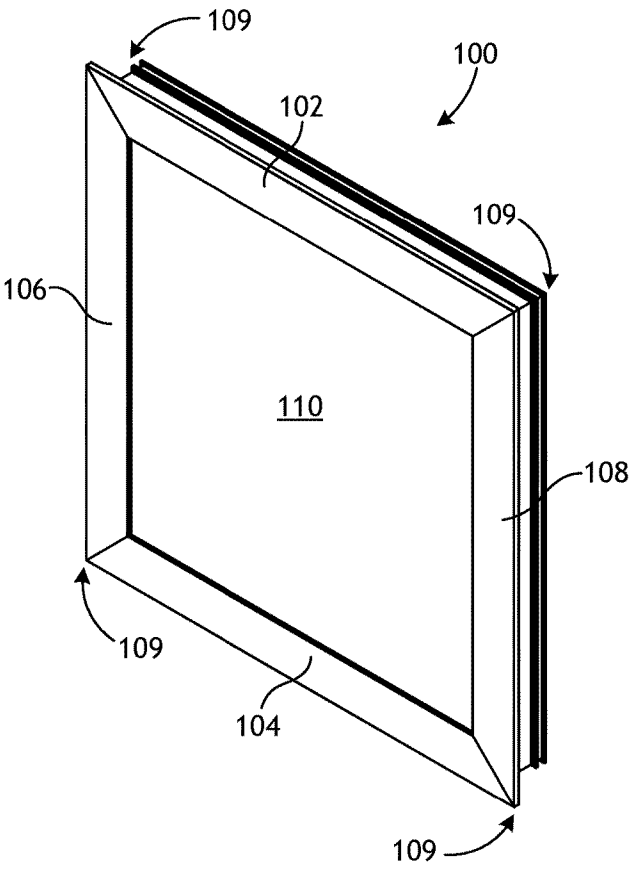

FIGS. 1A and 1B are isometric and exploded views, respectively, of an example framed assembly 100 that may incorporate one or more principles of the present disclosure. The framed assembly 100 may be employed in any commercial or residential building setting. In the illustrated embodiment, the framed assembly 100 comprises a window frame, but the principles of the present disclosure may be equally applicable to other types of framed assemblies including, but not limited to, window vents, glazing panels (alternately referred to as "glazing units"), doorframes, sliding glass doorframes, prefabricated framed façade elements (e.g., modular façade elements, picture frame facades, etc.), or any combination thereof. Accordingly, while the following discussion is generally directed to a framed assembly in the form of a window frame, any type of framed assembly mentioned herein may incorporate the presently disclosed features.

As illustrated, the framed assembly 100 includes a plurality of frame members (alternately referred to as "profiles"), shown as a top frame member 102, a bottom frame member 104, and opposing side frame members 106, 108 extending between the top and bottom frame members 102, 104. The top and bottom frame members 102, 104 may alternately be referred to as first and second "horizontal" frame members, and the side frame members 106, 108 may alternately be referred to as first and second "vertical" frame members. The frame members 102-108 may comprise hollow, generally rectangular tubes made of a variety of rigid materials including, but not limited to, aluminum, rolled sheet metal, a polymer, a composite material, or any combination thereof.

The ends of each frame member 102-108 meet adjacent ends of other adjacent frame members 102-108 at corresponding corner joints 109. In the illustrated embodiment, the frame members 102-108 are joined together at four corner joints 109, but other embodiments of the framed assembly 100 may employ more or less than four corner joints 109, without departing from the scope of the disclosure. Consequently, while four frame members 102-108 are depicted in FIGS. 1A-1B, other embodiments of the framed assembly 100 may require or incorporate more or less than four frame members, without departing from the scope of the disclosure.

The frame members 102-108 surround and otherwise "frame" a center panel 110. In the illustrated embodiment, the center panel 110 comprises a glazing panel, alternately referred to as a "glazing unit." As best seen in FIG. 1B, the center panel 110 may comprise double paned glass and may include air, an inert gas, and/or a plastic film(s) between adjacent panes to control transmission of thermal energy by radiation and convection between the interior of the building and the exterior environment. As will be appreciated, however, the center panel 110 may alternatively comprise any panel-shaped façade including, but not limited to, a wooden panel (e.g., a "sandwich" panel or cladding), polycarbonate, or another clear, translucent, tinted, or opaque panel, without departing from the scope of the disclosure.

As depicted in FIG. 1B, the framed assembly 100 may further include one or more corner cleats 112 positioned at each corner joint 109 of the framed assembly 100. While two corner cleats 112 are depicted at each corner joint 109, more or less than two may be employed at each corner joint 109, without departing from the scope of the disclosure. The corner cleats 112 are designed to interconnect and stabilize the ends of adjacent frame members 102-108, and thereby help stabilize the corner joints 109.

Each corner cleat 112 may provide a generally "L" shaped body extendable a short distance into corresponding inner channels 114 defined in the ends of the adjacent frame members 102-108. The ends of the corner cleats 112 may be secured within the corresponding inner channels 114 using a variety of attachment means including, but not limited to, an adhesive, a clamped engagement, one or more mechanical fasteners (e.g., screws, bolts, etc.), a magnetic attachment, or any combination thereof. As described herein, one or more of the corner cleats 112 may provide an internal conduit or passageway that allows a wire or wiring to traverse the corresponding corner joint 109 within the interior of the framed assembly 100. Consequently, wiring may extend within the interior of one frame member 102-108 and extend (pass) through a corner joint 109 to enter the interior of an adjacent frame member 102-108 without exiting the framed assembly 100.

As used herein, the term "wiring" may refer to any elongated communications line or cable capable of transferring electricity and/or data. Accordingly, the "wiring" may alternately be referred to herein as "wire" or "electrical wiring." In other applications, however, "wiring" may refer to any elongated cable, thread, or thread-wire not necessarily configured for electrical and/or data transfer. In such embodiments, the wiring may be used to actuate a mechanical device or the like via the mechanical movement of pulling the thread.

Figure 2:
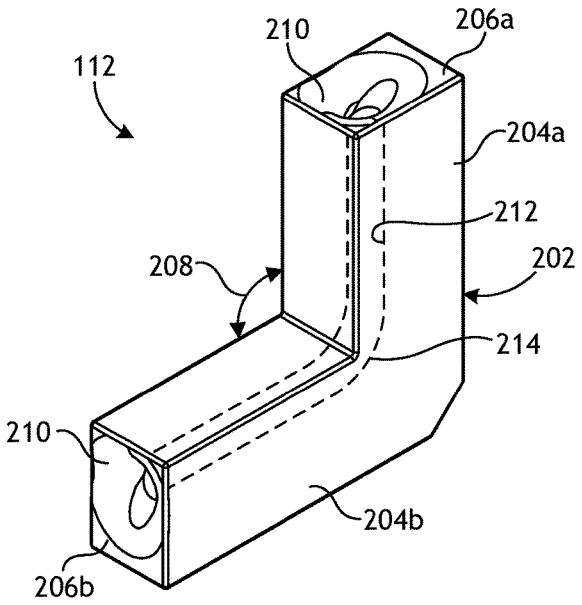
FIG. 2 is an isometric view of an example corner cleat, according to one or more embodiments.

FIG. 2 is an isometric view of an example corner cleat 112, according to one or more embodiments. As illustrated, the corner cleat 112 provides a generally rectangular, "L" shaped body 202 that includes a first leg 204*a* and a second leg 204*b*. The body 202 may be made of a variety of rigid materials including, but not limited to, a metal (e.g., aluminum, an aluminum alloy, steel, a steel alloy, etc.), a polymer (e.g., nylon, polypropylene, polyetherimide, polycarbonate, polystyrene, etc.), a composite material, or any combination thereof. The body 202 may be manufactured via a variety of known manufacturing processes including, but not limited to, injection molding, casting, machining, extruding, additive manufacturing (i.e., 3D printing), or any combination thereof.

While the body 202 is shown in FIG. 2 having specific dimensions, e.g., length, width, depth, etc., the principles of the present disclosure are equally applicable to corner cleats having varying dimensions. Accordingly, the specific dimensions and shape of the body 202 depicted in FIG. 2 is shown for illustrative purposes and should not be considered limiting to the present disclosure.

The first leg 204*a* terminates at a first end 206*a* of the body 202, and the second leg 204*b* terminates at a second end 206*b* of the body 202. The legs 204*a,b* extend outwardly from each other at an angle 208, which may generally match the angle of the corner joint 109 (FIGS. 1A-1B) where adjacent frame members 102-108 (FIGS. 1A-1B) meet. In some embodiments, the angle 208 may be 90°, but may alternatively be greater or less than 90°, without departing from the scope of the disclosure. For example, the angle 208 may range between about 30° and about 180°, but could certainly range anywhere between 0° and 180°, without departing from the scope of the disclosure.

As illustrated, an aperture 210 may be defined at each end 206*a,b* and may provide access into a passageway 212 (shown in dashed lines) defined in the body 202. The passageway 212 may interconnect the apertures 210, thus providing a contiguous conduit that generally extends between the first and second ends 206*a,b* of the body 202. In the illustrated embodiment, the passageway 212 is generally defined through the center of the body 202 such that access into the passageway 212 is only possible via the apertures 210 at the ends 206*a,b*. In some embodiments, the passageway 212 may exhibit a generally circular cross-section, but may alternatively exhibit other cross-sectional shapes, such as polygonal (e.g., triangular, square, rectangular, etc.), oval, or ovoid, without departing from the scope of the disclosure.

Each leg 204*a,b* may be sized and otherwise configured to be received within a corresponding inner channel 114 (FIG. 1B) defined in the ends of adjacent frame members 102-108 (FIGS. 1A-1B). When the corner cleat 112 is properly installed in adjacent frame members 102-108, the passageway 212 places the interior of one frame member 102-108 in communication with the interior of the adjacent frame member 102-108.

In some embodiments, the passageway 212 provides a conduit that traverses a corresponding corner joint 109 (FIGS. 1A-1B) within the interior of the framed assembly 100 (FIGS. 1A-1B). Consequently, the passageway 212 provides a pathway for extending (passing) a wire (not shown) between adjacent frame members 102-108 (FIGS. 1A-1B) via the cleat 112, e.g., between the interior of one of the vertical frame members 106, 108 and the interior of one of the adjacent horizontal frame members 102, 104, or vice versa.

In some embodiments, as illustrated, one or both of the apertures 210 may exhibit a diameter larger than the diameter of the passageway 212. In such embodiments, the apertures 210 may provide or otherwise define a sloped transition between the ends 206*a,b* of the body 202 and the passageway 212. The sloped transition may provide a guided opening that may help guide (direct) a wire toward the aperture 210 to be received within the passageway 212. This may prove especially advantageous when adding wiring after the corner cleat 112 is already installed in the framed assembly 100 (FIG. 1). In such embodiments, the wire may be advanced (pushed) within one of the frame members 102-108 (FIGS. 1A-1B) to the aperture 210, which helps direct the wire into the passageway 212. Once in the passageway 212, the wire may be advanced further until exiting the corner cleat 112 at the opposing aperture 210.

As illustrated, the passageway 212 may define a rounded corner 214 that provides a smooth and continuous transition between the first and second legs 204*a,b*. The corner 214 may have a radius that allows the wire to traverse the passageway 212 without binding against sharp or abrupt surfaces that might otherwise obstruct or prevent the wire from being pushed or pulled through the passageway 212. As will be appreciated, the larger the radius of the rounder corner 214, the easier it will be to push or pull a wire through the passageway 212.

In some embodiments, the passageway 212 may provide a conduit for extending (passing) a wire between adjacent frame members 102-108 (FIGS. 1A-1B), while simultaneously facilitating drainage between the adjacent frame members 102-108. More particularly, in at least one embodiment, the passageway 212 may also provide a conduit for draining accumulated moisture from the interior of one of the vertical frame members 106, 108 to the interior of the bottom frame member 104. Accordingly, water (or other liquids) that finds its way into a vertical frame member 106, 108 may locate the passageway 212 under the force of gravity and thereby flow into the adjacent bottom frame member 104 via the cleat 112. The enlarged diameter of the apertures 210 may help funnel the accumulated moisture into the passageway 212. Once in the bottom frame member 104, one or more drains or holes may be provided to allow the accumulated moisture to exit the framed assembly 100 (FIGS. 1A-1B).

Figure 3:
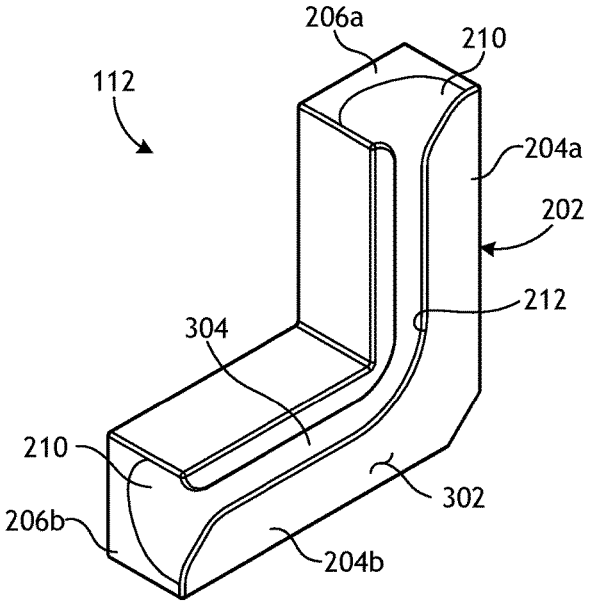
FIG. 3 is an isometric view of another example corner cleat, according to one or more embodiments.

FIG. 3 is an isometric view of another example corner cleat 112, according to one or more additional embodiments. The corner cleat 112 of FIG. 3 may be similar in some respects to the corner cleat 112 of FIG. 2, and therefore may be best understood with reference thereto, where like numerals represent like elements not described again. Similar to the corner cleat 112 of FIG. 2, for example, the corner cleat 112 of FIG. 3 includes the body 202 with the first and second legs 204*a,b* terminating at the first and second ends 206*a,b*, respectively. Moreover, the apertures 210 defined at each end 206*a,b* provide access into the passageway 212, which provides a contiguous conduit extending between the first and second ends 206*a,b*.

Unlike the corner cleat 112 of FIG. 2, however, the passageway 212 in FIG. 3 is not defined through the center of the body 202, but may instead be partially defined into one lateral side 302 of the body 202. More specifically, an opening 304 may be defined on the lateral side 302 and extend between the first and second ends 206*a,b*, thus providing lateral access to the passageway 212 along its entire length. The opening 304 may allow a user to insert or press a wire into the passageway 212 laterally prior to installing the corner cleat 112, which may ease wire installation. After the wire is placed in the passageway 212, opposing ends of the wire may be extended into corresponding inner channels 114 (FIGS. 1A-1B) of adjacent frame members 102-108 (FIGS. 1A-1B) and the corner cleat 112 may then be installed by receiving the legs 204*a,b* within the corresponding inner channels 114, as generally described above.

Alternatively, the corner cleat 112 may be installed first and the wire may be extended (passed) through the passageway 212 by pushing or pulling the wire through the passageway 212 from one aperture 210 to the other aperture 210. The larger diameter and sloped transition of the apertures 210, and the rounded corner 214 may help facilitate and ease this process.

Figure 4A:
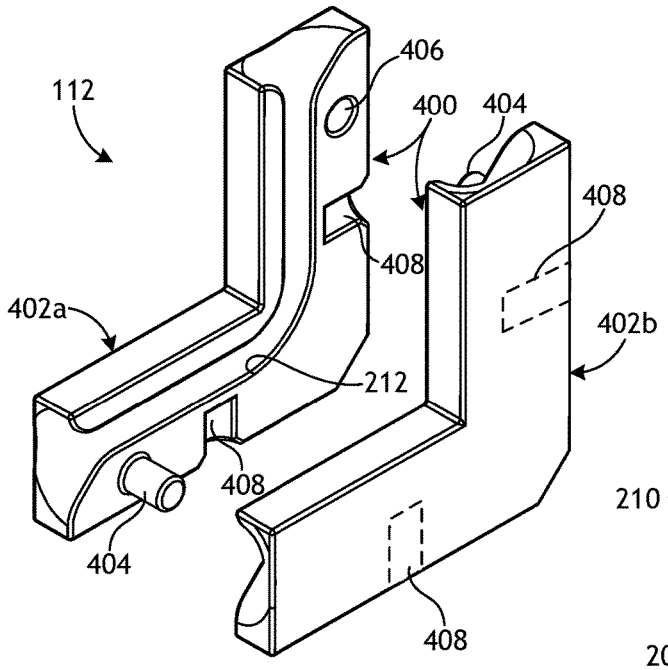
FIGS. 4A-4B are isometric exploded and assembled views, respectively, of another example corner cleat, according to one or more embodiments.
Figure 4B:
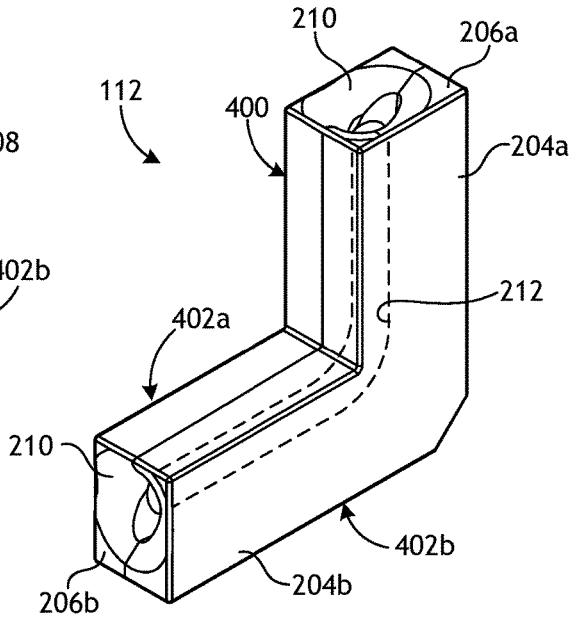

FIGS. 4A and 4B are isometric exploded and assembled views, respectively, of another example corner cleat 112, according to one or more additional embodiments. The corner cleat 112 of FIGS. 4A-4B may be similar in some respects to the corner cleats 112 of FIGS. 2 and 3, and therefore may be best understood with reference thereto, where like numerals will represent like elements not described again. Unlike the corner cleats 112 of FIGS. 2 and 3, the corner cleat 112 of FIGS. 4A-4B comprises a multi-component body 400. The body 400 may be made of any of the rigid materials and via any of the manufacturing processes mentioned herein with respect to the body 202 of FIGS. 2 and 3.

As illustrated, the body 400 provides a first component 402*a* and a second component 402*b*. In some embodiments, the first and second components 402*a,b* may be mirror images of each other and thus each forming an equal and half portion of the assembled body 400. In other embodiments, however, the first and second components 402*a,b* may provide greater or less than half portions of the assembled body 400, without departing from the scope of the disclosure.

The first and second components 402*a,b* may be matable to form the assembled body 400. In some embodiments, for example, and as best seen in FIG. 4A, the first and second components 402*a,b* may provide or otherwise define one or more dowels 404 and one or more corresponding holes 406. The dowels 404 may be sized to be received within the corresponding holes 406 and, in such embodiments, mating the dowels 404 with the corresponding holes 406 may properly align the first and second components 402*a,b* to form the assembled body 400. In some embodiments, the mated engagement between the dowels 404 and holes 406 may be fixed using, for example, an interference fit, a metal weld, a sonic or ultrasonic weld, a snap-fit engagement, an adhesive, a magnetic attachment, or any combination thereof. In other embodiments, however, the mated engagement between the dowels 404 and holes 406 may be releasable and otherwise not permanently fixed.

In yet other embodiments, the dowels 404 and the holes 406 may be omitted and the first and second components 402*a,b* may alternatively be mated using other types of engagements such as, but not limited to, a welded engagement, an adhesive, a snap-fit engagement, a magnetic attachment, or any combination thereof. In at least one embodiment, the first and second components 402*a,b* may be mated via an interference fit as inserted within an inner channel 114 (FIG. 1B) defined in a corresponding frame member 102-108 (FIGS. 1A-1B).

When the first and second components 402*a,b* are mated, as shown in FIG. 4B, the body 400 of the corner cleat 112 provides the first and second legs 204*a,b* terminating at the first and second ends 206*a,b*, respectively. Moreover, the apertures 210 defined at each end 206*a,b* provide access into the passageway 212, which provides a contiguous conduit extending between the first and second ends 206*a,b*. As best seen in FIG. 4A, the passageway 212 in the illustrated embodiment may be partially defined by each of the first and second components 402*a,b*, and mating the first and second components 402*a,b* forms the completed passageway 212. In other embodiments, the passageway 212 may alternatively be defined in only one of the first or second components 402*a,b*, with the other component 402*a,b* being used primarily for lateral expansion and fixation into the frame.

Forming the body 400 out of the first and second components 402*a,b* offer the possibility of placing (constraining) a wire in the passageway 212 before installing the corner cleat 112 within adjacent frame members 102-108 (FIGS. 1A-1B). More specifically, the wire may be inserted laterally into one portion of the passageway 212 defined in the first component 402*a*, following which the second component 402*b* may be mated to the first component 402*a* and thereby receive a portion of the wire in a second portion of the passageway 212 defined in the second component 402*b*.

By retaining the wire within the passageway 212 inside the corner cleat 112, the outer lateral sides of the body 400 remain planar and unmodified. As a result, these surfaces may be used for fixing the first and second legs 204*a,b* to the corresponding inner channels 114 (FIG. 1B) of the adjacent frame members 102-108 (FIGS. 1A-1B). The outer lateral surfaces of the legs 204*a,b* for example, can be affixed within the corresponding inner channels 114 using an adhesive, a clamped engagement, one or more mechanical fasteners (e.g., screws, bolts, etc.), a magnetic attachment, or any combination thereof.

In some embodiments, as seen in FIG. 4A, the body 400 may define one or more fastening holes 408 cooperatively defined by both components 402*a,b*. Portions of the fastening holes 408 are defined in each component 402*a,b*, and mating the first and second components 402*a,b* may fully form the fastening holes 408. The fastening holes 408 provide a location where the corner cleat 112 may be secured to adjacent frame members 102-108 (FIGS. 1A-1B) using mechanical fasteners (e.g., screws, bolts, etc.). In some embodiments, the depth of the fastening holes 408 may not penetrate the passageway 212, thus ensuring that the mechanical fasteners do not obstruct the passageway 212 to prevent electrical wiring from passing therethrough. In other embodiments, however, the mechanical fasteners may be long enough to penetrate passageway 212. In such embodiments, the mechanical fasteners may help fixate the wiring.

In at least one embodiment, the fastening holes 408 may be smaller than the mechanical fasteners, which may help ensure good mechanical fastening. Smaller fastening holes 408 may also prove advantageous in urging the first and second components 402*a,b* to expand outward within the corresponding inner channels 114 (FIG. 1B) of the adjacent frame members 102-108 as the mechanical fasteners are advanced into the fastening holes 408. This may result in a stronger engagement within the adjacent frame members 102-108.

FIGS. 5A-5D are progressive views of assembling an example corner joint 109 of the framed assembly 100 of FIGS. 1A-1B, according to one or more embodiments. The corner joint 109 may be representative of any of the corner joints 109 of FIGS. 1A-1B. In the illustrated embodiment, however, the corner joint 109 forms the transition between the adjacent ends of the bottom frame member 104 and the second side member 108. Moreover, in the illustrated embodiment, the corner joint 109 may employ the corner cleat 112 of FIGS. 4A-4B to stabilize the adjacent ends of the bottom frame member 104 and the second side member 108. In other embodiments, however, any of the corner cleats 112 described herein may be employed in the corner joint 109, without departing from the scope of the disclosure.

Figures 5A, 5B, 5C, 5D:
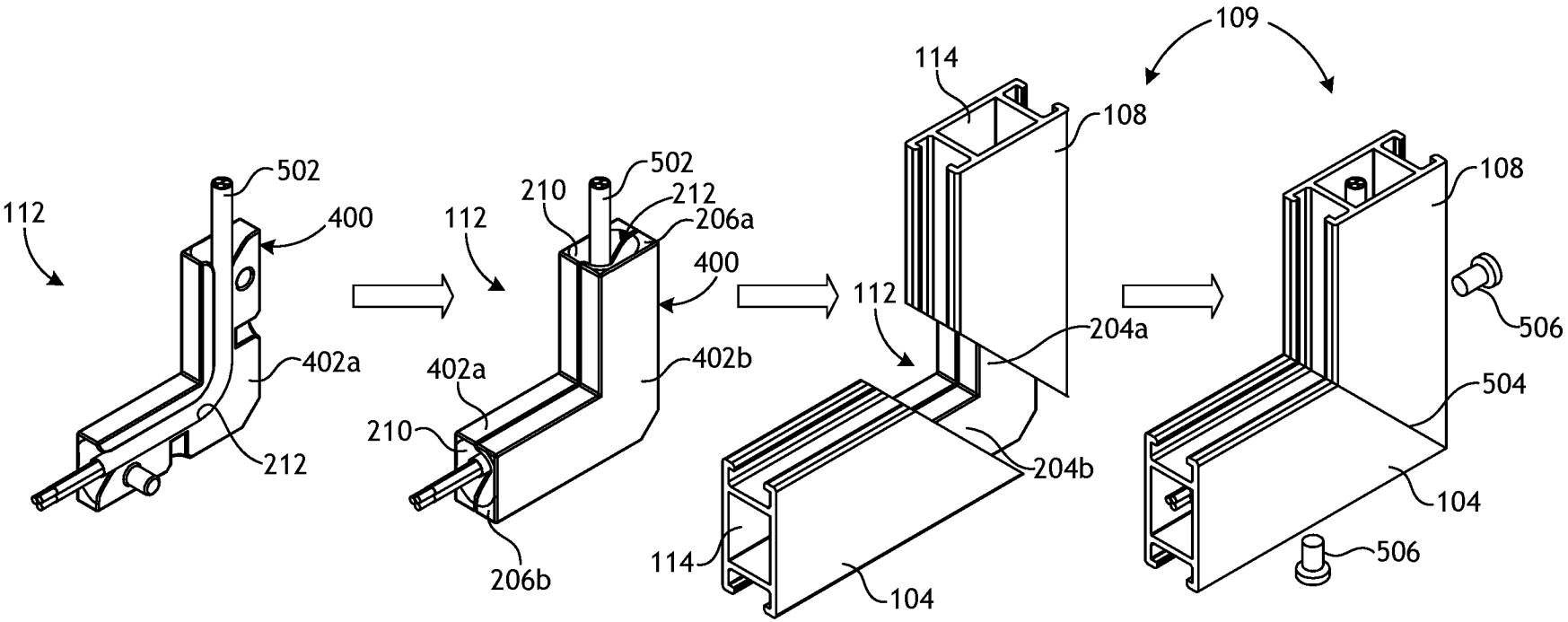
FIGS. 5A-5D are progressive views of assembling an example corner joint of the framed assembly of FIGS. 1A-1B, according to one or more embodiments.

In FIG. 5A, a segment of a wire 502 is received within a portion of the passageway 212 defined in the first component 402*a* of the body 400 of the corner cleat 112. In FIG. 5B, the body 400 is fully assembled by mating the second component 402*b* to the first component 402*a*, as generally described above. As the second component 402*b* mates to the first component 402*a*, the wire is received within a second portion of the passageway 212 defined in the second component 402*b*. As illustrated, the wire 502 extends along the entire length of the passageway 212 and extends out the apertures 210 at each end 206*a,b*.

In FIG. 5C, the first and second legs 204*a,b* are received into corresponding inner channels 114 defined in the second side member 108 and the bottom frame member 104, respectively. In FIG. 5D, the bottom frame member 104 and the second side member 108 are advanced toward one another until the adjacent ends of each member 104, 108 meet at a seam 504. To secure the corner cleat 112 (FIGS. 5A-5C) within the inner channels 114, one or more mechanical fasteners 506 may be received within corresponding fastening holes 408 (FIG. 4A) cooperatively defined by both components 402*a,b* (FIGS. 5A-5B), as generally described above.

FIGS. 6A-6E are progressive views of assembling another example corner joint 109 of the framed assembly 100 of FIGS. 1A-1B, according to one or more embodiments. Similar to the corner joint 109 of FIGS. 5A-5D, the corner joint 109 of FIGS. 6A-6E may be representative of any of the corner joints 109 of FIGS. 1A-1B. Moreover, in the illustrated embodiment, the corner joint 109 forms the transition between the adjacent ends of the bottom frame member 104 and the second side member 108 and employs the corner cleat 112 of FIGS. 4A-4B to stabilize the adjacent ends of the members 104, 108. In other embodiments, however, any of the corner cleats 112 described herein may be employed in the corner joint 109, without departing from the scope of the disclosure.

Figures 6A, 6B, 6C, 6D, 6E:
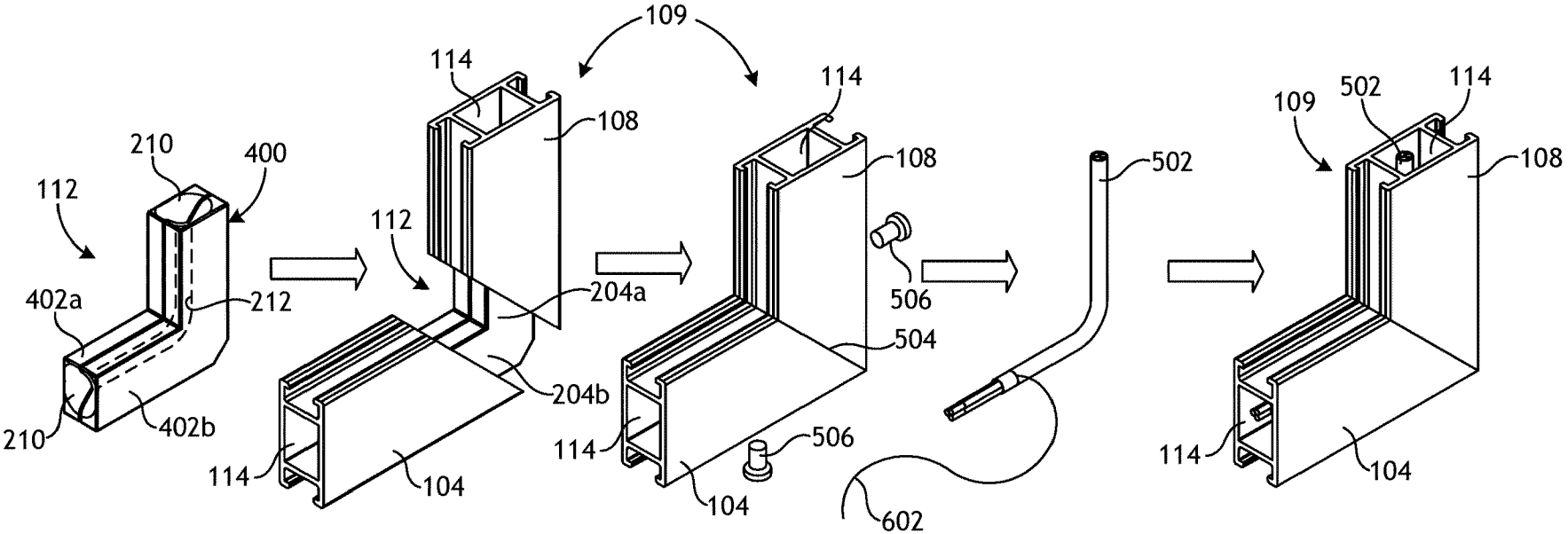
FIGS. 6A-6E are progressive views of assembling another example corner joint of the framed assembly of FIGS. 1A-1B, according to one or more additional embodiments.

In FIG. 6A, the body 400 is fully assembled by mating the second component 402*b* to the first component 402*a*, as generally described above. As the second component 402*b* mates to the first component 402*a*, the apertures 210 and the passageway 112 (shown in dashed lines) are fully formed. In FIG. 6B, the first and second legs 204*a,b* are received into corresponding inner channels 114 defined in the second side member 108 and the bottom frame member 104, respectively. In FIG. 6C, the bottom frame member 104 and the second side member 108 are advanced toward one another until the adjacent ends of each member 104, 108 meet at the seam 504. To secure the corner cleat 112 (FIGS. 6A-6B) within the inner channels 114, one or more mechanical fasteners 506 may be received within corresponding fastening holes 408 (FIG. 4A) cooperatively defined by both components 402*a,b* (FIG. 6A), as generally described above.

FIG. 6D depicts the wire 502 to be introduced into the passageway 212 (FIG. 6A), and FIG. 6E depicts the wire extended through the passageway 212. In some embodiments, the wire 502 may be pushed through the passageway 212 until the wire 502 extends out of both apertures 210 (FIG. 6A). In other embodiments, the wire 502 may be pulled through the passageway 212. In such embodiments, a line 602 may be attached to one end of the wire 502 and used to draw the wire through the passageway 212 until the wire 502 extends out of both apertures 210.

Accordingly, in the embodiment described in FIGS. 5A-5D, the wire 502 is extended through the passageway 212 before the framed assembly 100 (FIGS. 1A-1B) is fully constructed. In contrast, in the embodiment described in FIGS. 6A-6E, the wire 502 is extended through the passageway 212 after the framed assembly 100 is constructed. In either embodiment, the passageway 212 may also facilitate drainage between the adjacent frame members 104, 108. As moisture accumulates within the inner channel 114 defined in the second side member 108, the force of gravity may urge the moisture toward the passageway 212, which feeds the moisture into the inner channel 114 defined in the bottom frame member 104. As mentioned herein, once in the bottom frame member 104, one or more drains or holes may be provided in the bottom frame member 104 to allow the accumulated moisture to exit the framed assembly 100 (FIGS. 1A-1B).

Embodiments disclosed herein include:

A. A framed assembly includes a first frame member defining a first inner channel, a second frame member defining a second inner channel and positioned adjacent the first frame member at a corner joint, a corner cleat having a first leg received within the first inner channel and terminating at a first end of the corner cleat, and a second leg received within the second inner channel and terminating at a second end of the corner cleat, and a passageway defined in the corner cleat and extending between the first and second ends, wherein the passageway places the first inner channel in communication with the second inner channel. In a further embodiment of the framed assembly, the passageway is defined through a center of the corner cleat. In another further embodiment of any of the previous embodiments, the framed assembly may additionally and/or alternatively include wherein the passageway provides an opening defined in a lateral side of the corner cleat and extending between the first and second ends. In another further embodiment of any of the previous embodiments, the framed assembly may additionally and/or alternatively include wherein the corner cleat comprises a first component matable with a second component and the passageway is partially defined by each of the first and second components. In another further embodiment of any of the previous embodiments, the framed assembly may additionally and/or alternatively include wherein the passageway includes a rounded corner that transitions between the first and second legs. In another further embodiment of any of the previous embodiments, the framed assembly may additionally and/or alternatively include an aperture defined at each end of the corner cleat and providing access into the passageway, wherein at least one of the apertures exhibits a diameter larger than a diameter of the passageway. In another further embodiment of any of the previous embodiments, the framed assembly may additionally and/or alternatively include wiring positioned within the passageway and extending into the first and second inner channels.

B. A method of assembling a corner joint of a framed assembly includes extending a first leg of a corner cleat into a first inner channel of a first frame member, the first leg terminating at a first end of the corner cleat, extending a second leg of the corner cleat into a second inner channel of a second frame member, the second leg terminating at a second end of the corner cleat, advancing the first and second frame members toward each other to form a seam, and positioning wiring within a passageway defined in the corner cleat and extending between the first and second ends, wherein the wiring extends into the first and second inner channels. In a further embodiment, the method may further include positioning the wiring within the passageway precedes extending the first and second legs into the first and second inner channels, respectively. In another further embodiment of any of the previous embodiments, the method may additionally and/or alternatively include wherein the passageway provides an opening defined in a lateral side of the corner cleat and extending between the first and second ends, and wherein positioning the wiring within the passageway comprises inserting the wiring laterally into the passageway via the opening. In another further embodiment of any of the previous embodiments, the method may additionally and/or alternatively include wherein positioning the wiring within the passageway follows extending the first and second legs into the first and second inner channels, respectively. In another further embodiment of any of the previous embodiments, the method may additionally and/or alternatively include wherein an aperture is defined at the first end of the corner cleat and provides access into the passageway, and wherein the aperture exhibits a diameter larger than a diameter of the passageway, the method further comprising advancing the wiring to the aperture of the first end, engaging the wiring on a sloped transition defined by the aperture of the first end, and guiding the wiring into the passageway via the sloped transition. In another further embodiment of any of the previous embodiments, the method may additionally and/or alternatively include wherein advancing the wiring to the aperture of the first end comprises pulling the wiring to the aperture of the first end with a line attached to one end of the wiring, and drawing the wiring through the passageway with the line. In another further embodiment of any of the previous embodiments, the method may additionally and/or alternatively include wherein the corner cleat comprises first and second components and wherein extending the first and second legs into the first and second inner channels, respectively, is preceded by mating the first and second components. In another further embodiment of any of the previous embodiments, the method may additionally and/or alternatively include wherein the passageway is partially defined by each of the first and second components, and mating the first and second components comprises receiving a portion of the wire within a first portion of the passageway defined in the first component, and mating the second component to the first component and thereby receiving a remaining portion of the wire within a second portion of the passageway defined in the second component.

C. A corner cleat for a framed assembly includes an angled body providing a first leg terminating at a first end of the body, and a second leg terminating at a second end of the body, a passageway defined in the body and extending between the first and second ends, and an aperture defined at each end of the body and providing access into the passageway, wherein at least one of the apertures exhibits a diameter larger than a diameter of the passageway. The angled body may be substantially L-shaped. In a further embodiment, the corner cleat may further include wherein the body comprises a first component matable with a second component and the passageway is partially defined by each of the first and second components. In another further embodiment of any of the previous embodiments, the corner cleat may additionally and/or alternatively include wherein the first and second components are mated via a mated engagement selected from the group consisting of a dowel and hole engagement, an interference fit, a metal weld, a sonic or ultrasonic weld, a snap-fit engagement, an adhesive, a magnetic attachment, and any combination thereof. In another further embodiment of any of the previous embodiments, the corner cleat may additionally and/or alternatively include wherein the passageway is defined through a center of the body. In another further embodiment of any of the previous embodiments, the corner cleat may additionally and/or alternatively include wherein the passageway provides an opening defined in a lateral side of the body and extending between the first and second ends.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, and the like are used in relation to the illustrative embodiments as they are depicted in the figures, the upward direction being toward the top of the corresponding figure and the downward direction being toward the bottom of the corresponding figure.

What is claimed is:

1. A framed assembly, comprising:

a first frame member defining a first inner channel;

a second frame member defining a second inner channel and positioned adjacent the first frame member at a corner joint;

a corner cleat having a first leg received within and engageable with the first inner channel and terminating at a first end of the corner cleat, and a second leg received within and engageable with the second inner channel and terminating at a second end of the corner cleat; and a passageway defined in the corner cleat and terminating at an aperture defined at each of the first and second ends, wherein the passageway places the first inner channel in communication with the second inner channel, wherein at least one of the apertures exhibits a diameter larger than a diameter of the passageway and provides a sloped transition between a corresponding end of the first or second legs and the passageway, and wherein a cross-sectional size of the passageway is constant between the apertures defined at the first and second ends.

2. The framed assembly of claim 1, wherein the passageway is defined through a center of the corner cleat.

3. The framed assembly of claim 1, wherein the passageway provides an opening defined in a lateral side of the corner cleat and extending between the first and second ends.

4. The framed assembly of claim 1, wherein the corner cleat comprises a first component matable with a second component and the passageway is partially defined by each of the first and second components.

5. The framed assembly of claim 1, wherein the passageway includes a rounded corner that transitions between the first and second legs.

6. The framed assembly of claim 1, further comprising wiring positioned within the passageway and extending into the first and second inner channels.

7. The framed assembly of claim 1, wherein the passageway exhibits a circular cross-section.

8. A method of assembling a corner joint of a framed assembly, comprising:

extending a first leg of a corner cleat into a first inner channel of a first frame member, the first leg terminating at a first end of the corner cleat;

extending a second leg of the corner cleat into a second inner channel of a second frame member, the second leg terminating at a second end of the corner cleat;

advancing the first and second frame members toward each other to form a seam between the first and second frame members at the corner joint; and positioning wiring within a passageway defined in the corner cleat and extending the wiring into the first and second inner channels, the passageway terminating at an aperture defined at each of the first and second ends, wherein at least one of the apertures exhibits a diameter larger than a diameter of the passageway and provides a sloped transition between a corresponding end of the first or second legs and the passageway, and wherein a cross-sectional size of the passageway is constant between the aperture defined at each of the first and second ends.

9. The method of claim 8, wherein positioning the wiring within the passageway precedes extending the first and second legs into the first and second inner channels, respectively.

10. The method of claim 9, wherein the passageway provides an opening defined in a lateral side of the corner cleat and extending between the first and second ends, and wherein positioning the wiring within the passageway comprises inserting the wiring laterally into the passageway via the opening.

11. The method of claim 8, wherein positioning the wiring within the passageway follows extending the first and second legs into the first and second inner channels, respectively.

12. The method of claim 11, wherein the aperture defined at the first end provides access into the passageway, and wherein the aperture of the first end exhibits a diameter larger than a diameter of the passageway, the method further comprising:

advancing the wiring to the aperture of the first end;

engaging the wiring on a sloped transition defined by the aperture of the first end; and guiding the wiring into the passageway via the sloped transition.

13. The method of claim 12, wherein advancing the wiring to the aperture of the first end comprises:

pulling the wiring to the aperture of the first end with a line attached to one end of the wiring; and drawing the wiring through the passageway with the line.

14. The method of claim 8, wherein the corner cleat comprises first and second components and wherein extending the first and second legs into the first and second inner channels, respectively, is preceded by mating the first and second components.

15. The method of claim 14, wherein the passageway is partially defined by each of the first and second components, and mating the first and second components comprises:

receiving a portion of the wire within a first portion of the passageway defined in the first component; and mating the second component to the first component and thereby receiving a remaining portion of the wire within a second portion of the passageway defined in the second component.

16. A corner cleat for a framed assembly, comprising:

an angled body providing a first leg terminating at a first end of the body, and a second leg terminating at a second end of the body; and a passageway defined inside of the body and terminating at an aperture defined at each of the first and second ends, wherein the aperture defined at each end of the body provides access into the passageway, wherein at least one of the apertures exhibits a diameter larger than a diameter of the passageway and provides a sloped transition between a corresponding end of the body and the passageway, and wherein a cross-sectional size of the passageway is constant between the apertures defined at the first and second ends.

17. The corner cleat of claim 16, wherein the body comprises a first component matable with a second component and the passageway is partially defined by each of the first and second components.

18. The corner cleat of claim 17, wherein the first and second components are mated via a mated engagement selected from the group consisting of a dowel and hole engagement, an interference fit, a metal weld, a sonic or ultrasonic weld, a snap-fit engagement, an adhesive, and a magnetic attachment.

19. The corner cleat of claim 16, wherein the passageway is defined through a center of the body.

20. The corner cleat of claim 16, wherein the passageway provides an opening defined in a lateral side of the body and extending between the first and second ends.

* * * * *